United States Patent [19]

Pomfret

[11] Patent Number: 4,517,935

[45] Date of Patent: May 21, 1985

[54] DEVICE FOR TRANSMITTING MOVEMENT

[76] Inventor: Colin T. Pomfret, 9, Duggard Pl., Barford, CV35 8DX, Nr. Warwick, Warwickshire, England

[21] Appl. No.: 468,914

[22] Filed: Feb. 23, 1983

[51] Int. Cl.[3] ..... F01L 1/18

[52] U.S. Cl. ..... 123/90.4; 74/519; 137/637

[58] Field of Search ..... 123/90.22, 90.23, 90.4, 123/90.39; 74/519; 137/636, 637, 637.2, 637.4

[56] References Cited

U.S. PATENT DOCUMENTS

| | | | |
|---|---|---|---|
| 1,100,347 | 6/1914 | Bourcier | 123/90.23 |
| 1,618,878 | 2/1927 | Henry | 123/90.39 |
| 1,656,065 | 1/1928 | Heinemann | 123/90.23 |
| 1,693,832 | 12/1928 | Vincent | 74/519 X |
| 3,064,635 | 11/1962 | Rohrbacher | 123/90.41 |
| 3,150,648 | 9/1964 | Gropp | 123/90.39 |
| 3,179,094 | 4/1965 | Ribeton | 123/90.39 X |
| 3,401,678 | 9/1968 | Rose | 74/519 |
| 3,420,147 | 1/1969 | Beach | 74/519 |
| 4,183,252 | 1/1980 | Sossin | 123/90.39 X |

*Primary Examiner*—William R. Cline
*Assistant Examiner*—Peggy A. Neils
*Attorney, Agent, or Firm*—Mawhinney & Mawhinney & Connors

[57] ABSTRACT

The device comprises a rocker arm formed with a main bearing surface mounted on a main bearing and further bearing surfaces which co-operate with the upper ends of exhaust and inlet valves and pushrods respectively. Movement of one pushrod to open the inlet valve will turn the rocker arm a first axis and movement of the other pushrod to open the exhaust valve will turn the rocker arm about a second axis transverse to the first axis.

12 Claims, 4 Drawing Figures

DEVICE FOR TRANSMITTING MOVEMENT

Figure 1:
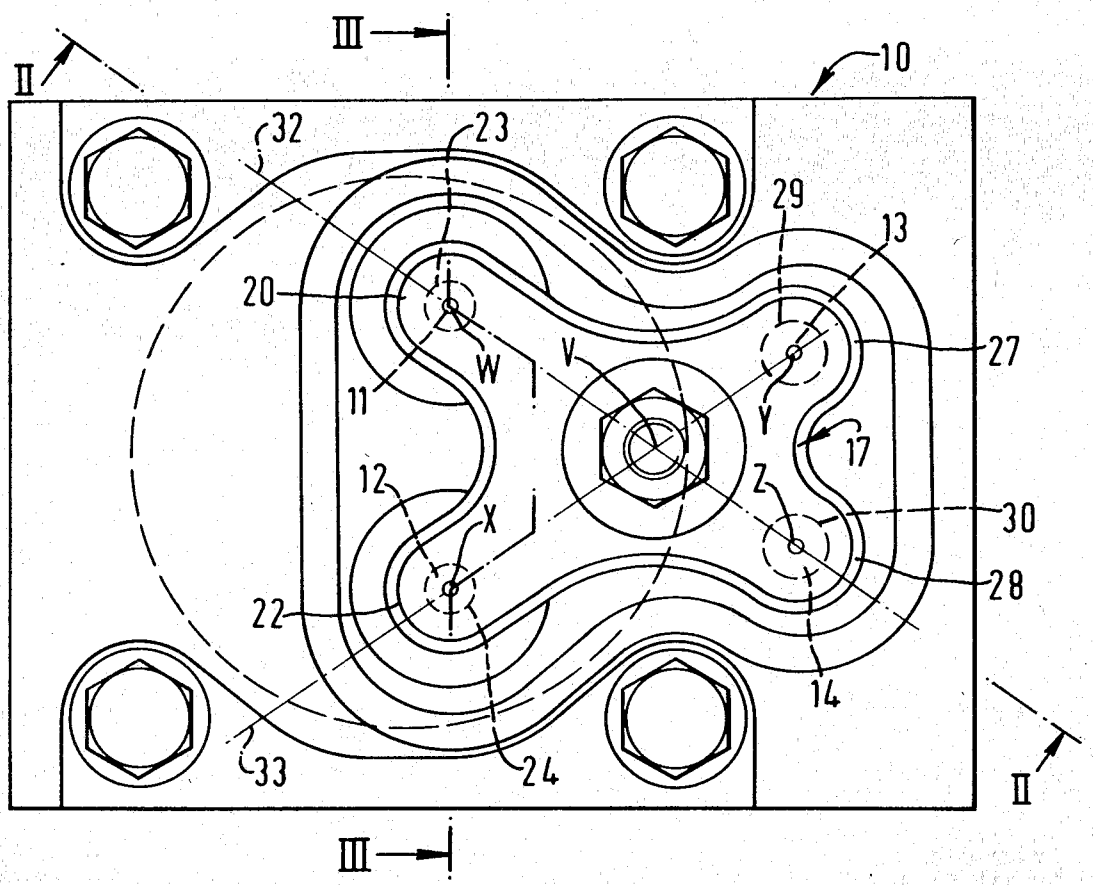

The invention relates to a device for transmitting movement from driving members to driven members and is particularly but not exclusively concerned with a device for transmitting movement between pushrods or other valve operating elements and valves of an internal combustion engine.

On internal combustion engines fitted with a pushrod system for operating overhead valves, motion is usually transmitted to the valves by one of the following two method:

(i) By means of a rocker arm which rotates on a shaft whereby the pushrod causes the rocker arm to pivot about that shaft and thus push down the valve, or (ii) By means of a stamped steel bucket-type rocker whereby the rocker pivots on a spherical surface located by a central stud and nut.

In each of the above methods, two rocker arms are required, one for each valve.

Such arrangements can give rise to problems where the space available for the rocker arms is somewhat limited. Also, the need to provide one rocker arm per valve complicates assembly.

An object of the present invention is to provide an improved device for transmitting movement such as movement from a pushrod or other valve operating element to a valve.

According to one aspect of the invention there is provided a device for transmitting movement from driving members to driven members comprising an arm arranged, in use, to engage the driving and driven members so that movement of one driving member will turn the arm about a first axis to transmit drive to one of the driven members, and movement of the other driving member will turn the arm about a second axis transverse to the first axis to transmit drive to the other driven member.

The arm may be mounted for pivotal movement on a main bearing co-operable with a main bearing surface which is preferably defined by an upper surface portion of the arm. Preferably the arm has further bearing surfaces on undersurface portions thereof arranged to co-operate with the driving and driven members. In such a case each of the first and second axes may pass through the pivotal centre of the main bearing surface and pivotal centres of two of the further bearing surfaces one of which further bearing surfaces co-operates with one of the driving members and the other of which cooperates with one of the driven members. Preferably all the pivotal centres lie in a common plane and the bearing surfaces may be spherical.

In a preferred embodiment the device is used in combination with driving members in the form of valve operating elements of an internal combustion engine and with driven members in the form of inlet and exhaust valves said device being arranged to transmit movement from said valve operating elements to the valves. In such a case the valve operating elements may comprise pushrods or hydraulic tappets. With such an arrangement only one arm is necessary to transmit movement from two pushrods or hydraulic tappets to inlet and exhaust valves associated therewith. As well as providing a cost saving by using a single arm, the single arm will take up less room than the two arms normally required.

Figure 2:
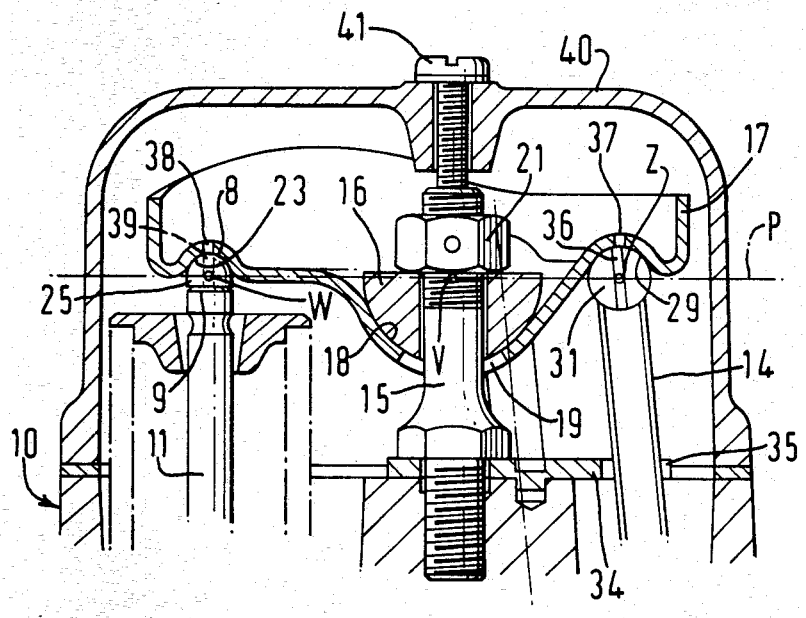
Figure 3:
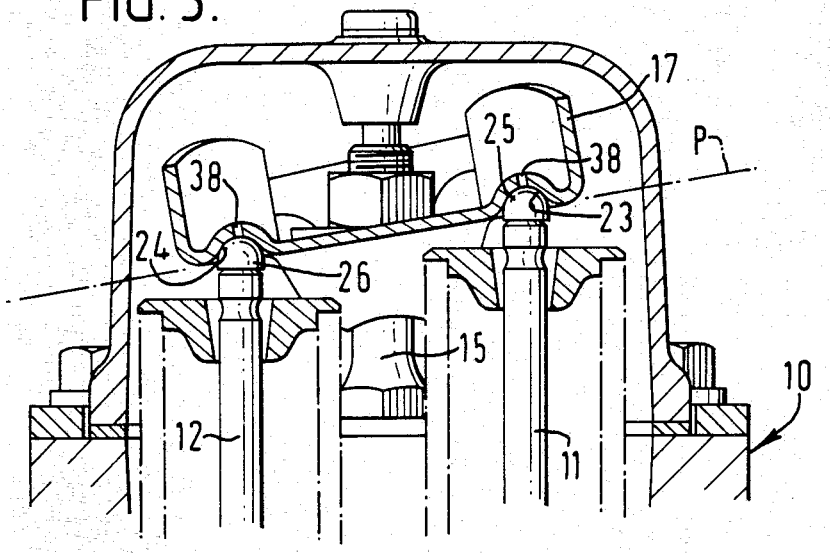
Figure 4:
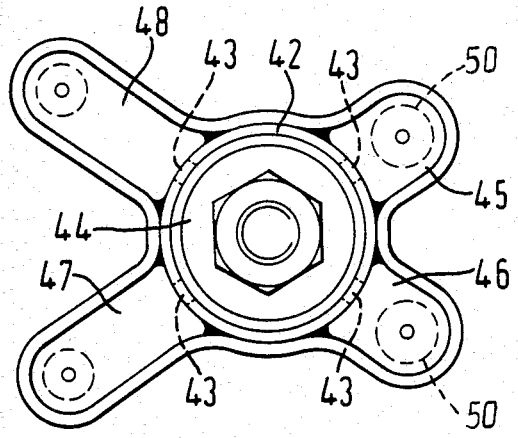

A device in accordance with the invention will now be described by way of example with reference to the accompanying drawings in which:

FIG. 1 is a plan view of part of an internal combustion engine having a valve, pushrod and rocker arm assembly in accordance with the invention, FIGS. 2 and 3 are cross-sections of the arrangement show in FIG. 1 on the lines II—II and III—III respectively in FIG. 1 with the rocker arm in two different positions, and FIG. 4 is a plan view of a reinforced rocker arm.

A cylinder head 10 carries exhaust and inlet valves 11, 12 in known manner. Valve operating elements in the form of tubular pushrods 13 14 project upwardly through the cylinder head from a camshaft (not shown). A stud 15 is screwed into the cylinder head and carries a spherical main bearing 16 for a rocker arm 17 formed as a hollow metal pressing. The bearing 16 engages a spherical upper main bearing surface 18 on the rocker arm, the latter being formed with an aperture 19 to enable the rocker to pivot on the bearing 16 without contacting the stud 15. The bearing 16 is held in place by a nut 21.

The rocker arm has two fingers 20, 22 formed on their undersurfaces with spherical bearing surfaces 23, 24 which locate respective valve activating elements 25, 26. Each activating element has a spherical upper surface 8 and a flat undersurface 9, the undersurface engaging the upper end of its associated valve.

The rocker arm has two further fingers 27, 28 formed on their undersurfaces with spherical bearing surfaces 29, 30 which locate spherical upper ends (one end 31 of which is shown in FIG. 2) of the pushrods 13, 14.

The centres of curvature of the spherical uppersurface 18, the spherical bearing surfaces 23, 24 on fingers 20, 22 and the spherical bearing surfaces 29, 30 on fingers 27, 28 are indicated respectively as V, W, X, Y and Z. The centres all lie in a common plane P and the centres W, V, Z and X, V, Y lie on axes 32 and 33 respectively.

In use, the inlet valve 12 is opened by upward movement of the pushrod 13 which causes the rocker arm to pivot about axis 32 on centres W, V, Z. At the same time, the exhaust valve 11 may be closing in which case the pushrod 14 will be descending and the rocker arm will simultaneously pivot about axis 33 on centres X, V, Y. The exhaust valve 11 is subsequently opened by upward movement of the pushrod 14. It will be seen, therefore, that the single rocker arm 17 will enable movement to be transmitted from the two pushrods 13, 14 (constituting the aforesaid driving members) to the two valves 11, 12 (constituting the aforesaid driven members) by turning the rocker arm 17 about axes which are transverse to each other.

A plate 34 having birfurcations (one only of which is shown in FIG. 2) is secured to the cylinder head 10 so that the pushrods 13, 14 slidably locate in the birfurcations. Alternatively, a single birfurcation can be provided for locating one pushrod only. The plate 34 thereby inhibits rotary movement of the rocker arm 17 about the axis of the stud 15. Alternatively rotary movement can be inhibited by forming a recess in the undersurface 9 of one of the valve activating elements 25, 26 which locates the upper end of the associated valve. Forces tending to rotate the rocker about the central stud are minimised by the alignment of each pushrod axis with its associated rocker axis 32, 33 respectively.

The various bearing surfaces require lubrication which may simply take the form of an oil feed into the hollow rocker arm from the centre of the stud 15, or an oil feed from the tubular pushrods 13, 14. In the latter case, each pushrod terminates at a narrow bore 36 at its spherical upper end. The bore 36 communicates with the interior of the rocker arm through an inlet aperture 37 in the bearing surface 29. Lubricant flows on to surface 18 and out through the aperture 19. An aperture 28 is formed in each of bearing surfaces 23, 24 for lubrication purposes and a small hole 39 drilled through each of the valve activating elements provides lubrication directly to the upper surface of each valve if required.

By using valve activating elements 25, 26 continuous face contact, rather than line contact, will be maintained with the upper ends of the valves, reducing the need for hardened contact faces. Also, the activators will compensate for movement of the rocker arm about the axes 32, 33. Alternatively the spherical bearing surfaces 23, 24 could, if made convex, engage suitably hardened flat upper ends of the valves.

To adjust the valve clearances, the pushrods could be provided with mechanical length adjusters or the cam followers could be of known hydraulic type. Alternatively, adjustment means could be provided on one pushrod, the second valve clearance being adjusted by varying the axial position of bearing 16 by means of nut 21.

A rocker cover 40 can be held in position by a bolt 41 which screws into the upper end of the stud 15.

For more arduous conditions the rocker arm may be reinforced as shown in FIG. 4. Reinforcement may be effected by means of a stiffening ring 42 within the arm which has a suitably shaped inner profile. Oil passages 43 through the stiffening ring allow transfer of oil between the interior 44 of the ring and resulting outer compartments 45–48. Other methods of reinforcement and manufacture (e.g. forging) of the rocker arm are possible.

Instead of moving the rocker arm 17 by means of pushrods, valve operating elements in the form of hydraulic tappets (indicated generally at 50 in FIG. 4) could be used.

Whilst specific reference has been made to a rocker arm for an internal combustion engine, the invention may be applied to other fields, e.g. the electrical field where switches are to be actuated by movement of actuating members.

What I claim as my invention and desire to secure by Letters Patent in the United States is:

1. An internal combustion engine having first and second operating members positioned substantially diagonally opposite respective inlet and exhaust valves, and a single arm for transmitting movement, from said operating members to the inlet and exhaust valves, the arm being mounted for pivotal movement about a pivotal centre lying on the intersection of diagonals between the operating members and valves, whereby movement of the first operating member will turn the arm about a first pivotal axis lying on the diagonal which extends between, the inlet valve and the second operating member to transmit movement to the exhaust valve, and movement of the second operating member will turn the arm about a second pivotal axis lying on the diagonal which extends between the exhaust valve and the first operating member to transmit movement to the inlet valve.

2. An internal combustion engine according to claim 1 in which the arm is mounted for pivotal movement on a main bearing co-operable with a curved main bearing surface defined by an upper surface portion of the arm, the arm has four curved further bearing surfaces on underside portions thereof two of which receive driving movement from the operating members and two of which transmit driving movement to said valves, and each of said first and second axes passes through the centre of curvature of the main bearing surface and centres of curvature of two of the further bearing surfaces one of which further bearing surfaces is associated with one of the operating members and the other of which is associated with one of the valves.

3. An internal combustion engine according to claim 2 in which all the centres of curvature lie in a common plane.

4. An internal combustion engine according to claim 2 in which all the bearing surfaces are spherical.

5. An internal combustion engine according to claim 4 in which each driven member includes an activating element which has a spherical bearing surface in contact with one of the further spherical bearing surfaces on the arm.

6. An internal combustion engine according to claim 2 in which the arm is formed with lubricant feed apertures in said further bearing surfaces.

7. An internal combustion engine according to claim 2 in which the arm is held in contact with the main bearing by a retainer including a retaining stud.

8. An internal combustion engine according to claim 7 in which means is provided to prevent rotation of the arm about the axis of the retaining stud, said means including a bifurcated plate which locates a said driving member.

9. A device according to claim 1 in which the arm includes two fingers for engagement with respective said driven members, two further fingers for engagement with respective said driving members and a central section from which the fingers extend.

10. An internal combustion engine according to claim 9 in which the arm is formed as in metal pressing reinforced by means of a stiffening ring.

11. An internal combustion engine according to claim 1 in which the valve operating members comprise pushrods.

12. An internal combustion engine according to claim 1 in which the valve operating members comprise hydraulic tappets.

* * * * *